United States Patent [19]

Love

[11] Patent Number: 4,898,385

[45] Date of Patent: Feb. 6, 1990

[54] BATTING PRACTICE DEVICE

[76] Inventor: Carl D. Love, 4348 Baton Rouge Dr., Hermitage, Tenn. 37076

[21] Appl. No.: 175,344

[22] Filed: Mar. 30, 1988

[51] Int. Cl.[4] ..... A63B 69/40

[52] U.S. Cl. ..... 273/26 E

[58] Field of Search ..... 273/26 E, 29 A, 29 R, 273/200 R, 26 R, 58 C, 411, 197 A, 200 B, 200 A; 446/247

[56] References Cited

U.S. PATENT DOCUMENTS 3,994,494 11/1976 Kelley ..... 273/26 E 4,322,075 3/1982 Hynes ..... 273/26 E

*Primary Examiner*—T. Brown

*Attorney, Agent, or Firm*—Mark J. Patterson

[57] ABSTRACT

A batting practice device has an arm extending horizontally from the top of a vertical pole. A vertical tether descends from the arm, supporting a ball at the other end. A horizontal tether is attached to the pole and is slidably attached to the vertical tether above the ball.

3 Claims, 1 Drawing Sheet

BATTING PRACTICE DEVICE

BACKGROUND OF THE INVENTION

The present invention relates to devices used to practice batting a baseball or softball.

Because it is often inconvenient or inefficient to use live or machine pitching for baseball batting practice, a number of prior art devices have been developed to allow a young baseball player to hit a baseball without the need for other players to pitch or retrieve the ball. Typical prior art structures are found in U.S. Pat. Nos. 4,322,075; 4,415,155; 3,830,494; 4,010,950; 4,050,694; 3,006,647; 3,366,383; 3,454,275; 2,976,040; 2,058,277; 4,508,340; and 4,502,684.

The prior art devices, however, have been deficient in one or more significant areas. Some are too complex and expensive for purchase and use by young ball players. Or, they lack features to prevent dangerous return movement of the ball after it is hit or to return the ball to a hitting position with a simulated pitching motion. For example, U.S. Pat. No. 4,322,075 is, in many respects, quite similar to the present invention, in that it has a horizontal and vertical tether. Yet, it has some of the drawbacks just referred to. Although the horizontal tether of the '075 device restricts dangerous return ball action, it also requires the batter to continue to hit a relatively stationary ball, as if on a batting tee. Also, the height of the horizontal tether on the pole must be adjusted for batters of varying size. In addition, because the horizontal tether is fixed at its ball-end, a mis-hit above the ball could cause injury to the batter when the bat motion is stopped abruptly by the restraining vertical and horizontal tethers.

What is needed, then, is a batting practice device which is tethered to maximize safety, which automatically self-adjusts to the strength and size of the batter, and which simulates a pitched ball motion.

SUMMARY OF THE INVENTION

The present invention is an improvement over conventional batting practice devices having a horizontal tether, comprising a vertical pole, a horizontal arm, a vertical tether supporting a ball, and a horizontal tether slidably attached to the vertical tether, not the ball. The length of the vertical and horizontal tethers, the height of the vertical pole, and the locations of the attachment points are selected within a range such that the hit ball will wrap around the vertical pole and then safely return to a hitting position and with a motion which simulates a pitched ball. The sliding attachment of the horizontal tether to the vertical tether allows the height and motion of the ball to adjust automatically to the size and strength of the batter.

DESCRIPTION OF THE PREFERRED EMBODIMENT

Figure 1:
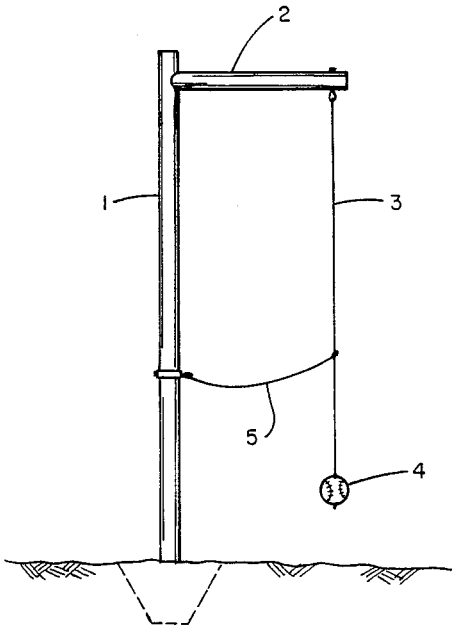
FIG. 1 is a side view of a ground-mounted batting practice device before use.

As best seen in FIG. 1, the present invention comprises a vertical pole 1, of conventional wood or metal construction, which can be ground-mounted as shown or attached to a weighted base for portability. The length of pole 1 above the ground or practice level should be approximately 104 inches to allow the practice device to be used by batters of varying sizes and strengths.

Attached to and extending horizontally from the top of pole 1 is arm 2, also of conventional construction. Extending downward from the lower surface of arm 2 is vertical tether 3, which is connected at a point approximately 20 inches from the pole using an eye bolt or other conventional fastener. Tether 3 is made of a non-elastic rope material and, again, for optimum universality of usage, should be approximately 81 inches long. Permanently affixed to the lower end of tether 3 is ball 4.

Horizontal tether 5, also non-elastic, is secured to the inside surface of pole 1 at a point approximately 40 inches above the practice surface, and is attached at its other end to vertical tether 3. The knot, such as a slip knot, or other means of attachment of tether 5 to tether 3 must allow for sliding vertical movement of the end of tether 5 along tether 3 under tension. "As seen in FIG. 1, sufficient frictional contact between the attachment means and tether 3 is maintained to fix the attachment point of tether 5 when the device is at rest." So attached, the position of tether 5 will adjust over an approximate 12 inch range to automatically compensate for the swing level and power of the batter. Experimentation has shown that the optimum length of tether 5 is approximately 28 inches, while the initial attachment point of tether 5 to tether 3 should be approximately 54 inches below arm 2. This provides tether 3 with the slack which is necessary to allow proper performance of the practice device.

Figure 2:
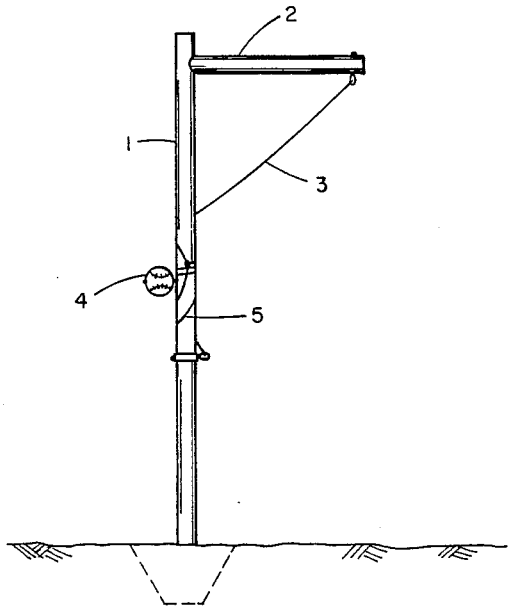
FIG. 2 is a side view of the device after the ball has been hit and before the return action begins.
Figure 3:
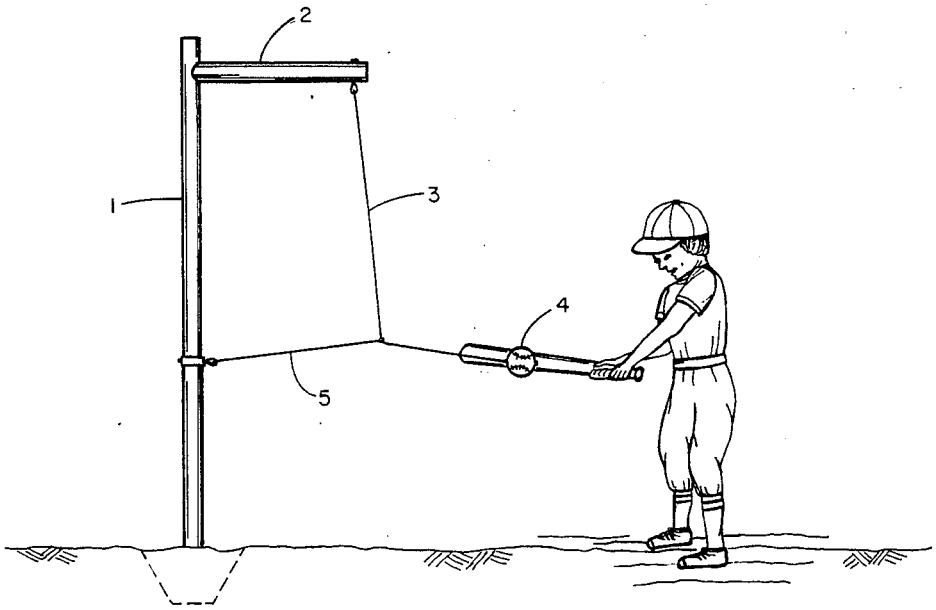
FIG. 3 is a side view of the device showing the ball being returned to the hitting position with a simulated pitched motion.

With the horizontal tether 3 slidably attached as described and shown, rather than directly to ball 4 as in the prior art, and by selecting the dimensions or ratio of dimensions of the other structures of the device to approximate those given above, the function of the device is optimized. As the batter approaches the device, its position is as shown in FIG. 1. The batter then will ordinarily place ball 4 in motion manually, causing tether 3 to move away from the batter and wrapping most of tethers 3 and 5 around pole 1, as seen in FIG. 2. The momentum of ball 4 and tension applied by tethers 3 and 5 cause ball 4 to unwrap and return to a hitting position with a swinging motion that simulates a pitched ball, as seen in FIG. 3. When ball 4 is hit, and tether 5 is placed under tension, tether 5 will slide up or down tether 3 to compensate for the level and strength of the swing. Of course, tethers 3 and 5 combine to prevent the ball and tether from wrapping around arm 2 or swinging back toward the batter with an unsafe level of velocity or travel. Similarly, and unlike the prior art horizontal tether devices, if the batter misses the ball and hits, instead, tether 3, the motion of the bat will not be abruptly halted because of the pendulum swing effect produced by the connection of tether 5 to tether 3.

What I claim is:

1. A batting practice device comprising:

a. a pole extending vertically from and secured to a practice surface;

b. an arm extending horizontally from the top of said pole;

c. a vertically extending tether means having its upper end attached to said arm;

d. a ball secured to the lower end of said vertical tether means;

e. a horizontal tether means with one end connected to said pole and the other end slidably connected to said vertical tether means at a point above said ball and intermediate said upper and lower end.

2. The device of claim 1 where the length of said horizontal tether means is such that when said ball is at rest, and when the connection point of said horizontal tether means to said vertical tether means is approximately two-thirds down the length of said vertical tether means, there is sufficient slack in said horizontal tether means to allow for approximately 12 inches of travel of said slidable connection along said vertical tether means when the ball is struck and in motion.

3. The device of claim 1 with dimensions or corresponding ratios of dimensions approximately as follows:

a. the length of said pole is 104 inches;

b. the length of said arm to the connection point of said vertical tether means is 20 inches;

c. the length of said vertical tether means is 81 inches;

d. the length of said horizontal tether means is 28 inches; and e. the distance from said practice surface to the attachment point of said horizontal tether means to said pole is 40 inches.

* * * * *